US006376104B1

(12) United States Patent
Li et al.

(10) Patent No.: US 6,376,104 B1
(45) Date of Patent: Apr. 23, 2002

(54) PRODUCTION OF GOLD DECORATIVE ITEMS

(76) Inventors: Kin Keung Li; Chi Shing Yuen, both of Room 1107, Block A, Focal Industrial Building, 21 Man Lok Street, Hung Hom (HK)

( * ) Notice: Subject to any disclaimer, the term of this patent is extended or adjusted under 35 U.S.C. 154(b) by 0 days.

(21) Appl. No.: 09/475,200

(22) Filed: Dec. 30, 1999

(51) Int. Cl.[7] ..... B44C 1/22

(52) U.S. Cl. ..... 428/687; 420/508; 420/511; 216/32; 216/100; 216/108; 29/896.4; 29/896.43; 510/409; 148/95

(58) Field of Search ..... 428/687; 420/507, 420/508, 511; 216/108, 100, 52, 32; 29/896.4, 896.43; 510/409; 148/95

(56) References Cited

U.S. PATENT DOCUMENTS 3,816,317 A 6/1974 MacArthur et al. ..... 252/79.5
5,045,411 A * 9/1991 Taylor et al.
5,126,007 A 6/1992 Shmulovich ..... 156/643
5,240,172 A * 8/1993 Steinke et al.

FOREIGN PATENT DOCUMENTS

| | | |
|---|---|---|
| EP | 0405006 | 7/1989 |
| FR | 1.475.888 | 2/1966 |
| JP | 63-60292 | 3/1988 |

* cited by examiner

*Primary Examiner*—Blaine Copenheaver
*Assistant Examiner*—Wendy Boss
(74) *Attorney, Agent, or Firm*—Leydig, Voit, & Mayer, Ltd.

(57) ABSTRACT

A process of producing a gold decorative item, including, sequentially producing an alloy of gold, silver, copper and zinc, forming the gold alloy into a specific shape according to the design of the decorative item and polishing the surface of the decorative item so formed, submerging the decorative item in an acid solution and etching its surface to form a scale pattern, submerging the decorative item in an alkaline solution removing unwanted substances formed on the surface during etching.

14 Claims, 1 Drawing Sheet

PRODUCTION OF GOLD DECORATIVE ITEMS

The present invention relates to a process of producing a gold decorative item and a gold decorative item so produced.

SUMMARY OF THE INVENTION

According to the invention, there is provided a process of producing a gold decorative item, comprising the steps in sequence of producing an alloy of gold, silver, copper and zinc, forming the gold alloy into a specific shape according to the design of the decorative item and polishing the surface of the decorative item so formed, submerging the decorative item in an acid solution for etching its surface to form a scale pattern, and submerging the decorative item in an alkaline solution for removing unwanted substances formed on the surface during etching.

Preferably, the acid solution is a solution comprising hydrochloric acid and nitric acid.

More preferably, the ratio by part of the hydrochloric acid to the nitric acid falls within the range from 3:1 to 5:1, with their concentrations being in the ranges of 30% to 50% and 55% to 75%, respectively.

It is preferred that the alkaline solution is a solution of sodium cyanide.

It is further preferred that the sodium cyanide solution has a concentration over 90%.

Advantageously, the process includes an additional step of applying ultrasonic irradiation to the decorative item when the item is submerged in the alkaline solution.

Preferably, the process includes a subsequent step of submerging the decorative item in second acid solution at an elevated temperature for removing low-value metals.

More preferably, the second acid solution comprises hydrosulphuric acid.

It is preferred that the alloy includes palladium.

In a preferred embodiment, the percentages by weight of the components of the alloy are in the ranges of 75% to 78% for gold, 13% to 18% for silver, 3% to 5% for copper, and 2% to 4% for zinc.

In another preferred embodiment, the percentages by weight of the components of the alloy are in the ranges of 75% to 78% for gold, 11% to 16% for silver, 4% to 6% for copper, and 2% to 3% for zinc.

More preferably, the alloy includes palladium at a percentage by weight in the range of 5% to 10%.

The invention also provides a gold decorative item produced by the aforesaid process, wherein the alloy includes palladium.

As an example, the percentages by weight of the components of the alloy are in the ranges of 75% to 78% for gold, 13% to 18% for silver, 3% to 5% for copper, and 2% to 4% for zinc.

As another example, the percentages by weight of the components of the alloy are in the ranges of 75% to 78% for gold, 11% to 16% for silver, 4% to 6% for copper, and 2% to 3% for zinc.

BRIEF DESCRIPTION OF DRAWINGS

The invention will now be more particularly described, by way of example only, with reference to the accompanying drawings, in which.

DETAILED DESCRIPTION OF PREFERRED EMBODIMENTS

Figure 1:
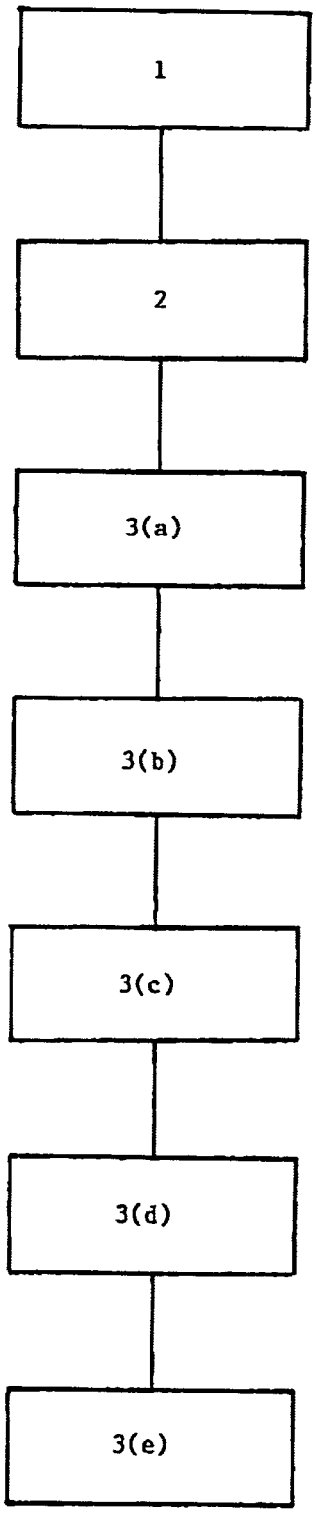
FIG. 1 is a flow chart illustrating an embodiment of a process of producing a gold decorative item in accordance with the invention.

Referring to the drawings, there is illustrated a process of producing a gold decorative item embodying the invention, which process comprises the following steps in sequence;

1. Producing a gold alloy of a specific composition;
2. Moulding the gold alloy into a specific shape according to the design of a decorative item, and is subsequently polishing the surface of the decorative item; and
3. Treating the surface of the decorative item to form a scale pattern thereon according to the following steps:
   (a) Submerging the decorative item in an acid bath and etching its surface to form the scale pattern, and then cleansing it with water;
   (b) Submerging the decorative item in an alkaline bath and removing a layer of unwanted coating formed on the surface during the etching step, and then cleansing it with water;
   (c) Submerging the decorative item in another acid bath at an elevated temperature and removing other low-value metals, and then cleansing it with water;
   (d) Submerging the decorative item in another alkaline bath and removing oil, and then cleansing it with water; and
   (e) Baking dry the decorative item.

Step 1

The method of producing the gold alloy is, in itself, generally known in the art, except the composition of the alloy. The specific compositions (by weight of the major metal components) of two gold alloys embodying the invention are as follows:

| Alloy I (18K yellow gold alloy) | |
|---|---|
| Gold (Au) | 75% to 78% |
| Silver (Ag) | 13% to 18% |
| Copper (Cu) | 3% to 5% |
| Zinc (Zn) | 2% to 4% |

| Alloy II (18K white gold alloy) | |
|---|---|
| Gold (Au) | 75% to 78% |
| Silver (Ag) | 11% to 16% |
| Copper (Cu) | 4% to 6% |
| Zinc (Zn) | 2% to 3% |
| Palladium (Pd) | 5% to 10% |

Gold is the base metal component, which is stable and inert to oxidation and of course attributes value to the alloy.

The existence of silver causes the alloy to become less yellow, and results in a pattern of scales which are lustrous and of an optimal size (for personal decorative items that are usually not too large in size). Too much silver will not only turn the alloy into a color that is too greenish but also reduce the size of the scales, hence the necessity of adding the other metals for balance. Copper is used to cause the alloy to look reddish and, in combination with silver, create the right golden color for the alloy. Its existence is the major source of relatively dark tone in the scale pattern. Excess quality of copper will not only turn the scale pattern too dark but also reduce the size of the scales.

Zinc causes the alloy to become greenish (like silver) and the pattern scales to become relatively larger and darker. Excessive zinc should be avoided for lowering the melting point and deteriorating the mechanical characteristics of the alloy.

Palladium is a stable metal like gold, and its addition will produce a relatively larger and moderately bright pattern of scales. Too much palladium will turn the scales creasy.

Step 2

The method of forming the gold alloy into shape according to the design of a decorative item is, in itself, generally known in the art, including for example moulding and/or stamping. The subsequent method of polishing the surface of the decorative item is also known.

Step 3(a)

The acid bath used is provided by a solution of four parts of hydrochloric acid (HCl) and one part of nitric acid ($HNO_3$). The ratio by part of the hydrochloric acid to the nitric acid should fall within the range from 3:1 to 5:1, with their concentrations being in the ranges of 30% to 50% (or about 38%) and 55% to 75% (or about 65%), respectively.

Figure 2:
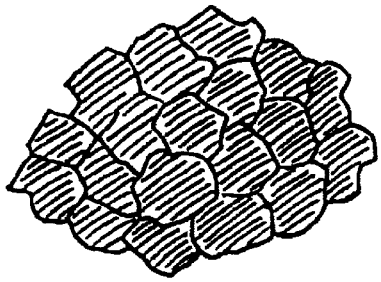
FIG. 2 is a diagram showing, on an enlarged scale, a part of a pattern of scales formed on the surface of the decorative item.

Etching is to be carried out at room temperature for a period of time of about 1 to 1½ minutes. When submerged, the highly polished surface of the decorative item will be attacked by the reagent. As the reagent has differential effects on the different components of the alloy and their crystalline structures or molecular arrangements, least on the high-value gold constituent, a pattern of scales is revealed (as shown in FIG. 2).

Step 3 (b)

The alkaline bath used is provided by a solution of sodium cyanide (NaCN) at a concentration over 90% or of about 95%, which is a strong alkaline solution.

The main purpose of this step is to remove the layer (or film) of unwanted substances formed, as a result of the etching step, as coating on the surface of the decorative item. It is preferred that the decorative item is simultaneously subjected to ultrasonic waves, in addition, for speeding up the process. The subsidiary purpose is to neutralise any residue acid left behind from Step 3(a).

Step 3(c)

The acid bath used is a solution of sulphuric acid ($H_2SO_4$) raised to a temperature of about 60° C. Removal of other low-value metals will stabilise the surface of the decorative item and cause the lustre of the scale pattern to be enduring.

Steps 3(d) and 3(e)

These two steps haven been generally-known in the art.

By way of the process as described above, a decorative item is produced to have a scale pattern all over its surface, of optimal size and light contrast. The composition of the gold alloy is also an important factor determining the characteristics of the scale pattern.

The invention has been given by way of example only, and various modifications of and/or alterations to the described embodiment may be made by persons skilled in the art without departing from the scope of the invention as specified in the appended claims.

What is claimed is:

1. A process of producing a gold decorative item comprising, sequentially:

producing a gold alloy including gold, silver, copper, and zinc, forming the gold alloy into a decorative item and polishing the decorative item, submerging the decorative item in an acid solution and etching a pattern, and submerging the decorative item in a sodium cyanide solution and removing substances formed on the decorative item during etching.

2. The process as claimed in claim 1, wherein the acid solution is a solution comprising hydrochloric acid and nitric acid.

3. The process as claimed in claim 2, wherein the hydrochloric acid is present in the acid solution in a ratio, by parts, to the nitric acid within a range from 3:1 to 5:1, and the hydrochloric and nitric acids have respective concentrations in ranges of 30% to 50%, and 55% to 75%.

4. The process as claimed in claim 1, wherein the sodium cyanide solution has a concentration exceeding 90%.

5. The process as claimed in claim 1, including applying ultrasonic waves to the decorative item when the decorative item is submerged in the sodium cyanide solution.

6. The process as claimed in claim 1, including submerging the decorative item in a second acid solution at an elevated temperature.

7. The process as claimed in claim 6, wherein the second acid solution comprises sulphuric acid.

8. The process as claimed in claim 1, wherein the gold alloy includes palladium.

9. The process as claimed in claim 1, wherein the gold alloy includes 75 wt % to 78 wt % gold, 13 wt % to 18 wt % silver, 3 wt % to 5 wt % copper, and 2 wt % to 4 wt % zinc.

10. The process as claimed in claim 1, wherein the gold alloy includes 75 wt % to 78 wt % gold, 11 wt % to 16 wt % silver, 4 wt % to 6 wt % copper, and 2 wt % to 3 wt % zinc.

11. The process as claimed in claim 10, wherein the gold alloy includes palladium in a range of 5 wt % to 10 wt %.

12. A gold decorative item produced by the process as claimed in claim 1, wherein the gold alloy includes palladium.

13. A gold decorative item produced by the process as claimed in claim 1, wherein the gold alloy includes 75 wt % to 78 wt % gold, 13 wt % to 18 wt % silver, 3 wt % to 5 wt % copper, and 2 wt % to 4 wt % zinc.

14. A gold decorative item produced by the process as claimed in claim 1, wherein the gold alloy includes 75 wt % to 78 wt % gold, 11 wt % to 16 wt % silver, 4 wt % to 6 wt % copper, and 2 wt % to 3 wt % zinc.

* * * * *